US010603528B1

(12) United States Patent
Bologna

(10) Patent No.: US 10,603,528 B1
(45) Date of Patent: Mar. 31, 2020

(54) RAPID EXTRACTION SYSTEM

(71) Applicant: Frank Harold Bologna, Knoxville, TN (US)

(72) Inventor: Frank Harold Bologna, Knoxville, TN (US)

( * ) Notice: Subject to any disclaimer, the term of this patent is extended or adjusted under 35 U.S.C. 154(b) by 0 days.

(21) Appl. No.: 15/797,149

(22) Filed: Oct. 30, 2017

Related U.S. Application Data

(60) Provisional application No. 62/414,061, filed on Oct. 28, 2016.

(51) Int. Cl.
*A62B 35/00* (2006.01)
*A62B 5/00* (2006.01)

(52) U.S. Cl.
CPC ..... *A62B 35/0006* (2013.01); *A62B 5/00* (2013.01)

(58) Field of Classification Search
CPC ..... A01K 27/003; A62B 35/006
See application file for complete search history.

(56) References Cited

U.S. PATENT DOCUMENTS 303,896 A 8/1884 Tharp
579,818 A * 3/1897 Cooley ..... B60R 22/26 297/468
1,063,738 A * 6/1913 Ruland ..... B66C 1/18 294/74
1,218,714 A * 3/1917 Sunderland ..... B66C 1/18 24/115 R
2,431,780 A * 12/1947 Theal ..... A45F 3/14 224/157
2,931,629 A * 4/1960 Keller ..... A01M 31/00 254/409
3,023,941 A 3/1962 Foley
3,038,644 A * 6/1962 Johnson ..... A01M 31/00 224/184
3,480,275 A 11/1969 Jernstrom et al.
3,592,502 A 7/1971 Bolliger
3,709,545 A 1/1973 Oltmanns
4,384,583 A 5/1983 Speelman et al.
4,478,311 A * 10/1984 Anderson ..... A62B 35/0068 119/857
4,479,267 A * 10/1984 Radowsky, Jr. ... A62B 35/0006 2/337
4,529,240 A * 7/1985 Engel ..... A22B 5/161 24/129 R
4,759,311 A * 7/1988 Boyle ..... A01K 27/00 119/857
4,856,836 A * 8/1989 Delphin ..... B66C 1/18 294/74
4,951,778 A 8/1990 Halvorson
4,999,853 A * 3/1991 Tanner ..... A41F 9/002 2/321
5,067,484 A 11/1991 Hiemstra-Paez
(Continued)

*Primary Examiner* — Colleen M Chavchavadze
(74) *Attorney, Agent, or Firm* — Patterson Intellectual Property Law, P.C.; Gary L. Montle

(57) ABSTRACT

A rapid extraction harness for dragging a victim from a dangerous area may include at least two straps. The straps may each include a hook portion with a section of hooks and a loop portion including a section of loops opposite the hook portion. The section of hooks and the section of loops may removably attach to each other. Each strap may also include a connection point between the hook portion and the loop portion. A connector may be attached to the connection point of each of the straps.

3 Claims, 4 Drawing Sheets

(56) References Cited

U.S. PATENT DOCUMENTS 5,081,714 A 1/1992 Liu
5,518,481 A * 5/1996 Darkwah ..... A63B 21/0004 482/126
5,539,933 A 7/1996 Garber et al.
5,540,188 A * 7/1996 Heinrichs ..... A47D 13/086 119/770
5,603,545 A 2/1997 Benson et al.
5,664,844 A * 9/1997 Greene ..... A47D 15/006 119/770
5,709,172 A * 1/1998 Maglich ..... A01K 27/003 119/795
5,718,189 A * 2/1998 Blake ..... A01K 27/00 119/770
5,848,576 A * 12/1998 Colaianni ..... A01K 27/003 119/770
6,089,636 A * 7/2000 Harris ..... A01K 1/0236 294/150
6,125,792 A * 10/2000 Gee ..... A47D 13/046 119/770
6,508,389 B1 * 1/2003 Ripoyla ..... A45F 3/14 182/3
6,569,005 B2 * 5/2003 Maxwell ..... A22B 5/161 452/125
6,932,027 B1 * 8/2005 Whitney ..... A01K 27/00 119/770
6,978,485 B2 12/2005 Stude
7,059,503 B2 * 6/2006 Andersen ..... A45F 3/14 224/578
7,467,419 B2 12/2008 O'Neal et al.
D612,436 S * 3/2010 Schirmer ..... D21/662
8,016,335 B2 9/2011 McKay
8,038,584 B1 * 10/2011 Pruessner ..... A61H 1/02 482/143
8,177,026 B2 * 5/2012 Wood ..... A62B 35/0068 182/9
8,292,028 B2 10/2012 Wise
8,343,018 B2 * 1/2013 Moulton ..... A63B 21/0004 482/131
8,360,202 B1 1/2013 Woodard
9,198,525 B2 * 12/2015 Wernick ..... A47D 13/025
9,586,074 B2 * 3/2017 Autogue ..... A63B 23/0355
9,592,418 B2 * 3/2017 Burrell ..... A61F 5/026
9,826,817 B2 * 11/2017 Whitehill ..... A45F 3/02
9,943,122 B2 * 4/2018 Conrad ..... A62B 35/0006
10,207,141 B2 * 2/2019 Belveal ..... A63B 21/4007
D861,087 S * 9/2019 Mantione, III ..... D21/694
2003/0136807 A1 7/2003 Falzone et al.
2003/0213645 A1 11/2003 Pine
2005/0227814 A1 * 10/2005 Takemura ..... A63B 21/0004 482/44
2006/0070800 A1 * 4/2006 Lewis ..... A62B 35/0006 182/3
2007/0084667 A1 4/2007 Waters et al.
2008/0000486 A1 * 1/2008 Wilson ..... A61G 1/044 128/898
2008/0132392 A1 * 6/2008 Moulton ..... A63B 21/0004 482/122
2008/0256680 A1 10/2008 Peksoz et al.
2009/0095232 A1 * 4/2009 McKay ..... A62B 35/0006 119/770
2010/0243372 A1 9/2010 Wilkinson
2014/0171275 A1 * 6/2014 Tatum ..... A63B 21/0004 482/124
2014/0353348 A1 12/2014 Nielsen
2015/0136825 A1 * 5/2015 Kalck ..... A45F 3/047 224/653
2016/0183666 A1 * 6/2016 Whitehill ..... A45F 3/02 224/578

* cited by examiner

RAPID EXTRACTION SYSTEM

CROSS-REFERENCES TO RELATED APPLICATIONS

This application claims benefit of U.S. Provisional Patent Application No. 62/414,061, filed Oct. 28, 2016, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND

The present disclosure relates generally to harnesses for rapid extraction of a person that is incapacitated from an emergency situation. More particularly, the present disclosure relates to various embodiments of a harness for rapid extraction of incapacitated individuals from a fire, wherein for example conventional tools requiring an upright posture are undesirable or impractical.

For over two hundred years, firefighters in the United States have been trusted with the task of not only controlling and extinguishing fires, but also ensuring the health and welfare of the victims of dangerous situations. There have been many changes in the approach to fighting fires. Firefighters have received updated equipment and training for assessing and combatting fires.

One area of fire and rescue has not experienced a similar degree of advancement. Extracting a victim from a structure fire or other dangerous situation is largely the same as it was over two hundred years ago. This method of extracting a victim includes grabbing the victim in any way possible and pulling the victim by one hand while sliding across the floor. A firefighter usually must slide across the floor while seated to accomplish this method. Such a method may be very time consuming and can drain the firefighter's strength quickly. A rescue is much more likely to succeed if it takes as little time as possible.

Another problem relates to various conventional tools and techniques that require rescue personnel to maintain an upright or largely upright position during extraction of the incapacitated individual. In a fire emergency, it is often essential that the rescue personnel assume a crouched or crawling position near the ground in order to minimize exposure. Extraction harnesses and the like which have been developed for military use, and even many such tools which have been applied for firefighters themselves, have failed to adequately address this important issue.

Many conventional tools and techniques present additional problems which can be critical in an emergency evacuation situation, particularly relating to structure fires or the like. For example, such prior art tools may typically fail to facilitate raising of the incapacitated individual from the ground, resulting in movement friction from the dragging action that takes place, and further frequently requiring the full use of both arms of the rescuer. Finally, such tools typically fail to leverage an appropriately ergonomic position, or otherwise are utterly impractical for rescuers that are relatively small as compared to the incapacitated individual.

BRIEF SUMMARY

In one embodiment, the present disclosure is directed to a harness apparatus for rapid extraction of a victim by a rescuer. The apparatus may include a plurality of straps. Each strap may include a hook portion with a section of hooks; a loop portion with a section of loops, the loop portion opposite the hook portion and configured to removably attach to the hook portion; and a connection point between the hook portion and the loop portion. A connector may be attached to the connection point of each of the plurality of straps.

In another embodiment, the present disclosure is directed to a harness apparatus for rapid extraction of a victim by a rescuer. The apparatus may include a plurality of straps, each strap including a proximal end and a distal end opposite the proximal end. The distal end may include a section of hook and loop fasteners configured to attach to a corresponding section of hook and loop fasteners of another of the plurality of straps. A connector may be attached to the proximal end of each of the plurality of straps.

In yet another embodiment, the present disclosure is directed to a method of using a harness apparatus for rapid extraction of a victim by a rescuer. The method may include fastening a rescuer strap hook portion to a corresponding rescuer strap loop portion around a rescuer; fastening a victim strap hook portion to a corresponding victim strap loop portion around a victim; and the rescuer pulling the victim by pulling the harness apparatus.

In yet another embodiment, the present disclosure is directed to a "closed loop" harness apparatus for rapid extraction of a victim by a rescuer, similar to the previous apparatus but having a continuous, closed loop on the rescuer end without detachable connections. An exemplary method of use for such an apparatus may include fastening a rescuer loop portion around a rescuer; fastening a victim strap hook portion to a corresponding victim strap loop portion around a victim; and the rescuer pulling the victim by pulling the harness apparatus.

Numerous objects, features, and advantages of the present invention will be readily apparent to those skilled in the art upon a reading of the following disclosure when taken in conjunction with the accompanying drawings.

DETAILED DESCRIPTION

Figure 1:
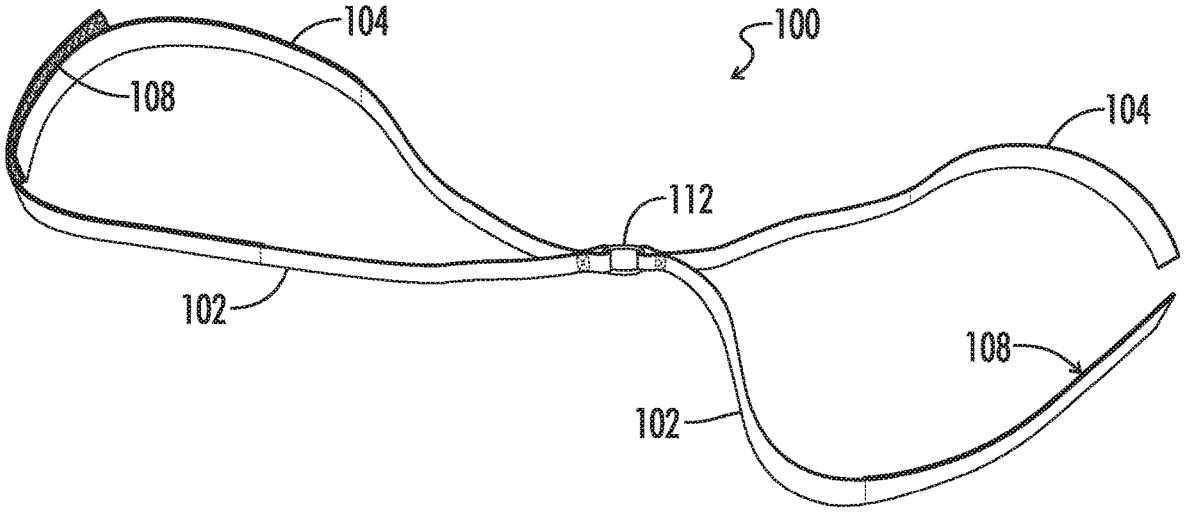
FIG. 1 is a perspective view of an embodiment of a rapid extraction system according to the present disclosure.
Figure 2:
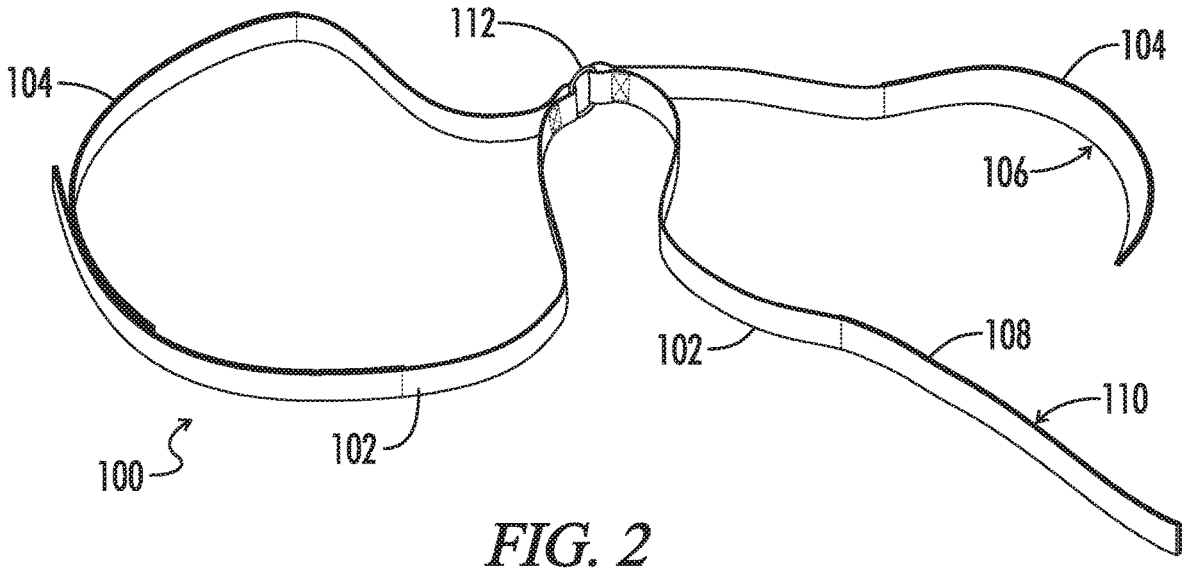
FIG. 2 is a perspective view of the rapid extraction system of FIG. 1, with one of the hook ends disengaged from the corresponding loop end.

Various embodiments of the present invention will now be described with reference to the accompanying drawings. Many embodiments are contemplated. The disclosure should not, however, be construed to be limited to the embodiments set forth herein.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states.

The term "hook" as used herein may typically be interpreted in accordance with the understanding of one of ordinary skill in the art, but may further and more broadly relate to equivalent fasteners including but not limited to clasps, grapnels, clamps and the like.

The term "strap" as used herein may typically be interpreted in accordance with the understanding of one of ordinary skill in the art, relating to for example an elongated strip of material as further described below, but further unless otherwise expressly stated encompassing without limitation belts, bands, ropes, cables and the like.

In FIGS. 1-4, an embodiment of a rapid extraction system 100 is shown. The rapid extraction system 100 may include a plurality of straps 102. Each strap 102 may include a section of hooks 104 at a hook portion 106 and a section of loops 108 at a loop portion 110. The section of hooks 104 and section of loops 108 may fasten to each other. Each strap 102 may be connected to a connector 112. In the exemplary embodiment as illustrated in FIGS. 1-4, each strap 102 may be passed through the connector 112 and subsequently sewn over itself (or otherwise joined to itself) to form a permanent or semi-permanent connection to the connector.

Alternatively, two separate straps may be used in place of each strap 102 of the figures. In this embodiment, each of the separate straps may have a hook and/or loop section on a distal end and a proximal end permanently or semi-permanently joined to the connector.

The straps 102 may be formed of, in non-limiting examples, a para-aramid synthetic fiber (for instance, Kevlar) and/or a flame-resistant meta-aramid material (for instance, Nomex) webbing. These materials may allow heat resistance to better maintain the strength of the straps 102 while in an environment with increased temperatures due to a fire. The straps 102 may be, in a non-limiting example, flat straps that are 1.5 inches to 2 inches wide. An alternative embodiment of the rapid extraction system 100 may include further straps 102 to allow multiple rescuers to pull a single victim.

In some embodiments, the portions 106, 110 may attach to each other with hooks 104 and loops 108, but the portions may also attach to each other in any manner that allows for rapid attachment and rapid release. Non-limiting examples of attachment manners may include snap buttons, metal hooks, buckles, and the like.

The connector 112 may be a continuous loop formed of a metallic, non-metallic, or composite material. Alternatively, the connector 112 may be selectively opened, a non-limiting example being a carabiner or some other clip. Also, the connector 112 may be yet another section of the same material as the straps 102 sewn (or otherwise joined) on itself or to each of the straps. In one embodiment, the connector 112 is a steel ring that is 2.5 inches to 3 inches in diameter and welded to itself to form a continuous ring.

In one embodiment, reflective tape (not shown) may be attached to the straps 102. The reflective tape may make the straps more visible in dark or otherwise low-visibility conditions. Two distinct colors of reflective tape may be used to indicate corresponding ends of the straps 102.

In an embodiment, all the components of the rapid extraction system 100 may be constructed of or coated with appropriate materials to withstand high temperatures, a non-limiting example being materials heat rated for 400 degrees Fahrenheit. Some or all of the components of the rapid extraction system 100 may, in a non-limiting example, be heat rated for up to 600 degrees Fahrenheit for a limited time (a non-limiting example being 3 to 5 minutes). The rapid extraction system 100 may also be of the proper dimensions and including the proper materials to bear weights of, in non-limiting examples, up to 500-600 pounds. In one embodiment, the rapid extraction system 100 may allow for dragging a victim of at least approximately 250 pounds.

A method of using a rapid extraction system 100 may include fastening a hook portion 106 to a corresponding loop portion 110 around a rescuer; fastening a second hook portion to a second corresponding loop portion around a victim; and the rescuer pulling the victim by pulling the rapid extraction system.

In an alternative embodiment, wherein an apparatus (not shown) is provided with a closed loop (continuously extending and without connectors) on the rescuer portion, a method of using a rapid extraction system may include fastening a the closed loop rescuer portion around a rescuer; fastening a hook portion to a corresponding loop portion around a victim; and the rescuer pulling the victim by pulling the rapid extraction system.

Figure 3:
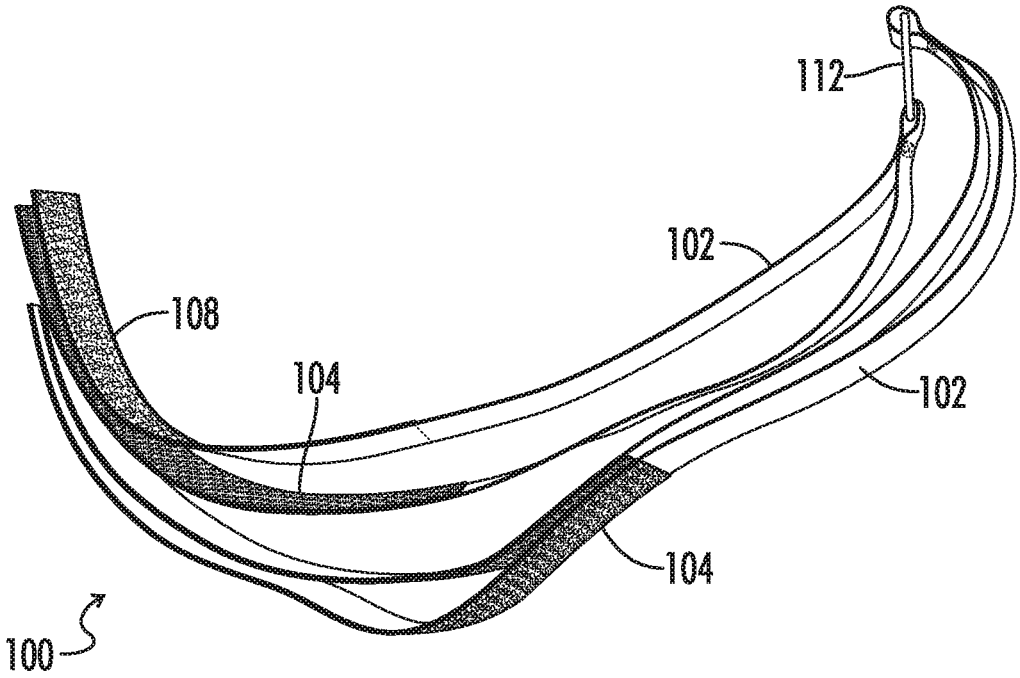
FIG. 3 is a perspective view of the rapid extraction system of FIG. 1, wherein both of the hook ends are disengaged from the corresponding loop ends and the system is folded over itself in preparation for storage.
Figure 4:
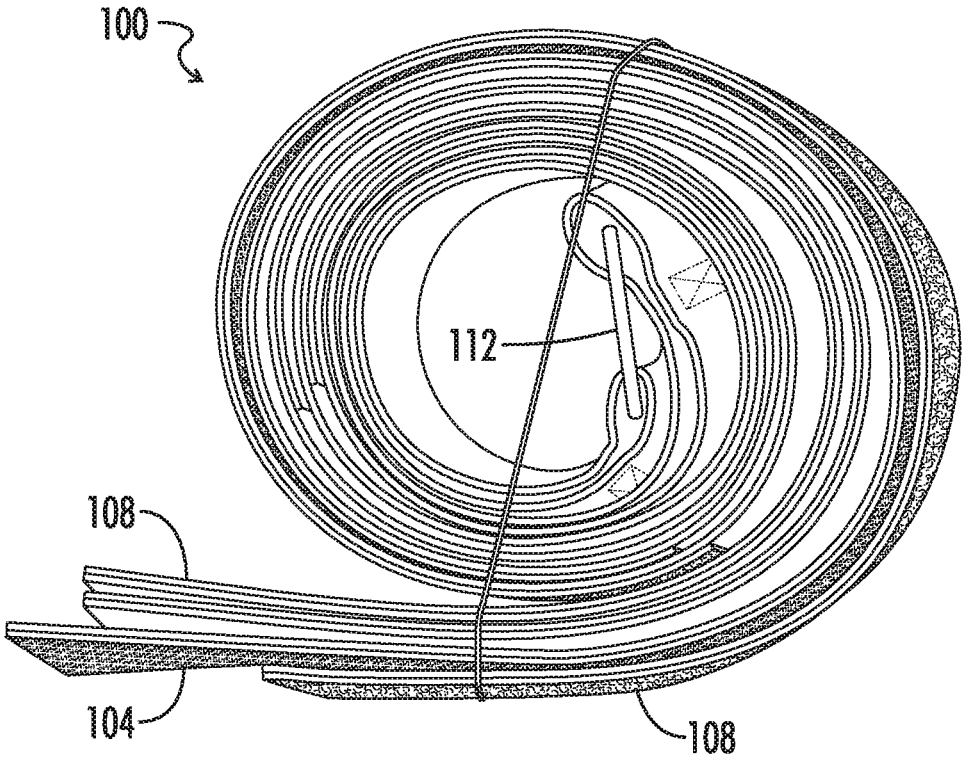
FIG. 4 is a perspective view of the rapid extraction system of FIG. 1, wherein the system is rolled on itself to be stored.

As shown in FIGS. 3 and 4, the rapid extraction system may be stored by ensuring all the portions 106, 110 of the straps 102 are disengaged from each other; positioning the straps next to each other; and rolling the straps onto themselves to form a bundle of the straps. The bundle may also be secured with, in a non-limiting example, a rubber band or some other securing device. In one embodiment, the straps may be sized so the bundle is small enough to fit in the cargo pocket of a firefighter's bunker pants or some other pocket on a firefighter's personal protective equipment. In some embodiments, the entire rapid extraction system may weigh about one pound. Some embodiments of the rapid extraction system may be deployed and attached to the rescuer and victim in less than ten seconds.

At least one embodiment of the rapid extraction system 100 may allow the rescuer to drag the victim while the rescuer is walking or crawling on both hands and feet/knees. These methods of dragging may allow for increased speed in removing the victim from a dangerous area.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims Thus, although there have been described particular embodiments of the present disclosure of a rapid extraction system, it is not intended that such references be construed as limitations upon the scope of this disclosure except as set forth in the following claims.

I claim:

1. A harness apparatus for rapid extraction of an incapacitated victim by a rescuer from an emergency situation while the rescuer is in crouched or crawling position near a ground level, the apparatus consisting of:

a continuous annular connector;

a first strap extending through the annular connector and connected to itself at a central portion to define an interior enclosing the annular connector, wherein first and second strap portions extend from the central portion to respective distal ends that are selectively fastened to each other with a fastening feature;

a second strap extending through the annular connector and connected to itself at a central portion to define an interior enclosing the annular connector, wherein third and fourth strap portions extend from the central portion to respective distal ends that are selectively fastened to each other.

2. The harness apparatus of claim 1, wherein the fastening feature is a hook and a loop, respectively.

3. The harness apparatus of claim 1, wherein the fastening feature is corresponding adhesive portions.

* * * * *